United States Patent [19]

Kolb et al.

[11] 3,997,335

[45] Dec. 14, 1976

[54] METHOD OF OPTIMUM BURNING OF CARBON MONOXIDE IN A CONVERTER

[75] Inventors: William A. Kolb, Forest Hills Borough; Jack F. Sigh, Crafton Borough, both of Pa.

[73] Assignee: United States Steel Corporation, Pittsburgh, Pa.

[22] Filed: Apr. 3, 1975

[21] Appl. No.: 564,942

Related U.S. Application Data

[60] Division of Ser. No. 309,018, Nov. 24, 1972, Pat. No. 3,895,714, and a continuation-in-part of Ser. No. 295,761, Oct. 6, 1972, abandoned

[52] U.S. Cl. ..... 75/60; 75/59

[51] Int. Cl.[2] ..... C21C 5/34

[58] Field of Search ..... 75/59, 60

[56] References Cited

UNITED STATES PATENTS

| | | | |
|---|---|---|---|
| 2,986,458 | 5/1961 | Johnson | 75/60 |
| 3,839,017 | 10/1974 | Schempp | 75/52 |

*Primary Examiner*—P. D. Rosenberg
*Attorney, Agent, or Firm*—David S. Urey

[57] ABSTRACT

An improved method of optimum burning of carbon monoxide in a carbon monoxide zone (being fed oxygen by a side tuyere) above a molten metal bath in a converter to carbon dioxide is disclosed.

The improved method includes the steps of:

a. sensing an initial effectiveness signal of the amount of carbon monoxide in the carbon monoxide zone being burned to carbon dioxide at a predetermined point relative to the converter;

b. monitoring a continuing effectiveness signal;

c. comparing the continuing effectiveness signal with the initial effectiveness signal; and d. moving the side tuyere relative to the converter and adjusting $O_2$ flow when all possible side tuyere positions are exhausted when the continuing effectiveness signal is greater than the initial effectiveness signal to increase the amount of carbon monoxide in the carbon monoxide zone being burned to carbon dioxide.

The apparatus has sensing means associated with the converter for sensing the initial effectiveness signal of the amount of carbon monoxide in the carbon monoxide zone being burned to carbon dioxide at a predetermined point relative to the converter. The sensing means is then operable to monitor the continuing effectiveness signal. Comparison means are connected to the sensing means for comparing the continuing effectiveness signal with the initial effectiveness signal. Tuyere operating means are connected to the comparison means and the side tuyere for moving the side tuyere relative to the converter and adjusting $O_2$ flow when the continuing effectiveness signal is greater than the initial effectiveness signal to increase the amount of carbon monoxide in the carbon monoxide zone being burned to carbon dioxide.

18 Claims, 13 Drawing Figures

(A) FROM LINE 20

(B) FROM LINE 22

(A) FROM LINE 20 FIGURE 1

(B) FROM LINE 22 FIGURE 1

METHOD OF OPTIMUM BURNING OF CARBON MONOXIDE IN A CONVERTER

This application is a Continuation-in-Part application of U.S. pat. application Ser. No. 295,761 filed Oct. 6, 1972 by applicants now abandoned and a division of Ser. No. 309,018, filed Nov. 24, 1972 and now U.S. Pat. No. 3,895,714.

BACKGROUND OF THE INVENTION

Heretofore, conventional Q-BOP vessels or converters have been provided with side jet lances or side tuyeres. However, none of the conventional converters have been provided with a control system which can either position the side lances or adjust the oxygen flow rate to such side lances in response to a signal which is a measure of the effectiveness of the burning of the carbon monoxide generated by the process in the carbon monoxide zone above the molten metal bath in the converter. Such an automatic control system is desirable to permit the maximum scrap usage in the converter by the utilization of substantially all available heat generated in the carbon monoxide zone by the Q-BOP refining process and utilizing such maximum available heat for scrap melting.

OBJECTS OF THE INVENTION

It is the general object of this invention to avoid and overcome the foregoing and other difficulties of and objections to prior art practices by the provision of an improved method of optimum burning of cabron monoxide within a converter to produce a substantially maximum amount of heat to melt as much scrap as possible in the converter. This improved method:

a. provide an improved and novel control system which can either position the side tuyere or adjust the oxygen flow rate to the side tuyere in response to a signal which is a measure of the effectiveness of the side tuyere position and the oxygen flow rate through such side tuyere:

b. provide a substantially maximum amount of heat generated in the carbon monoxide zone above the molten metal bath in the vessel to permit maximum scrap usage in the refining process;

c. utilize all available heat from the refining process and the burning of the carbon monoxide in the carbon monoxide zone for scrap melting;

d. continuously monitor either the carbon monoxide content at a predetermined point relative to the converter or the temperature of the off gases above the carbon monoxide zone at such predetermined point against an initial effectiveness signal; and e. time the operation of the initial effectiveness signal, the monitored continuing effectiveness signal, the comparison therebetween, the movement of the side tuyere relative to the converter and the change in the oxygen supply to the side tuyere as a programmed cycle.

SUMMARY OF THE INVENTION

The aforesaid objects of this invention and other objects which will become apparent as the description proceeds are achieved by providing an improved method of optimum burning of carbon monoxide to carbon dioxide in a carbon monoxide zone within the converter.

The improved method includes the steps of:

a. sensing an initial effectiveness signal of the amount of carbon monoxide in the carbon monoxide zone being burned to carbon dioxide at a predetermined point relative to the converter;

b. monitoring a continuing effectiveness signal;

c. comparing the continuing effectiveness signal with the initial effectiveness signal; and d. moving the said tuyere relative to the converter when the continuing effectiveness signal is greater than the initial effectiveness signal to increase the amount of carbon monoxide in the carbon monoxide zone being burned to carbon dioxide.

The apparatus has sensing means associated with the converter for sensing the initial effectiveness signal of the amount of carbon monoxide in the carbon monoxide zone being burned to carbon dioxide at a predetermined point relative to the converter. The sensing means is then operable to monitor the continuing effectiveness signal. Comparison means are connected to the sensing means for comparing the continuing effectiveness signal with the initial effectiveness signal. Tuyere operating means are connected to the comparison means and the side tuyere for moving the side tuyere relative to the converter when the continuing effectiveness signal is greater than the initial effectiveness signal to increase the amount of carbon monoxide in the carbon monoxide zone being burned to carbon dixide.

BRIEF DESCRIPTION OF THE SEVERAL VIEWS OF THE DRAWINGS

For a better understanding of this invention, reference should be had to the accompanying drawings wherein like numerals of reference indicate similar parts throughout the several views and wherein.

Although the principles of this invention are broadly applicable to the control of the position of a side tuyere with respect to a converter and the control of a gaseous flow rate to such side tuyere, this invention is particularly adapted for use in conjunction with a Q-BOP converter and hence it has been so illustrated and will be so described.

DETAILED DESCRIPTION

Figure 1:
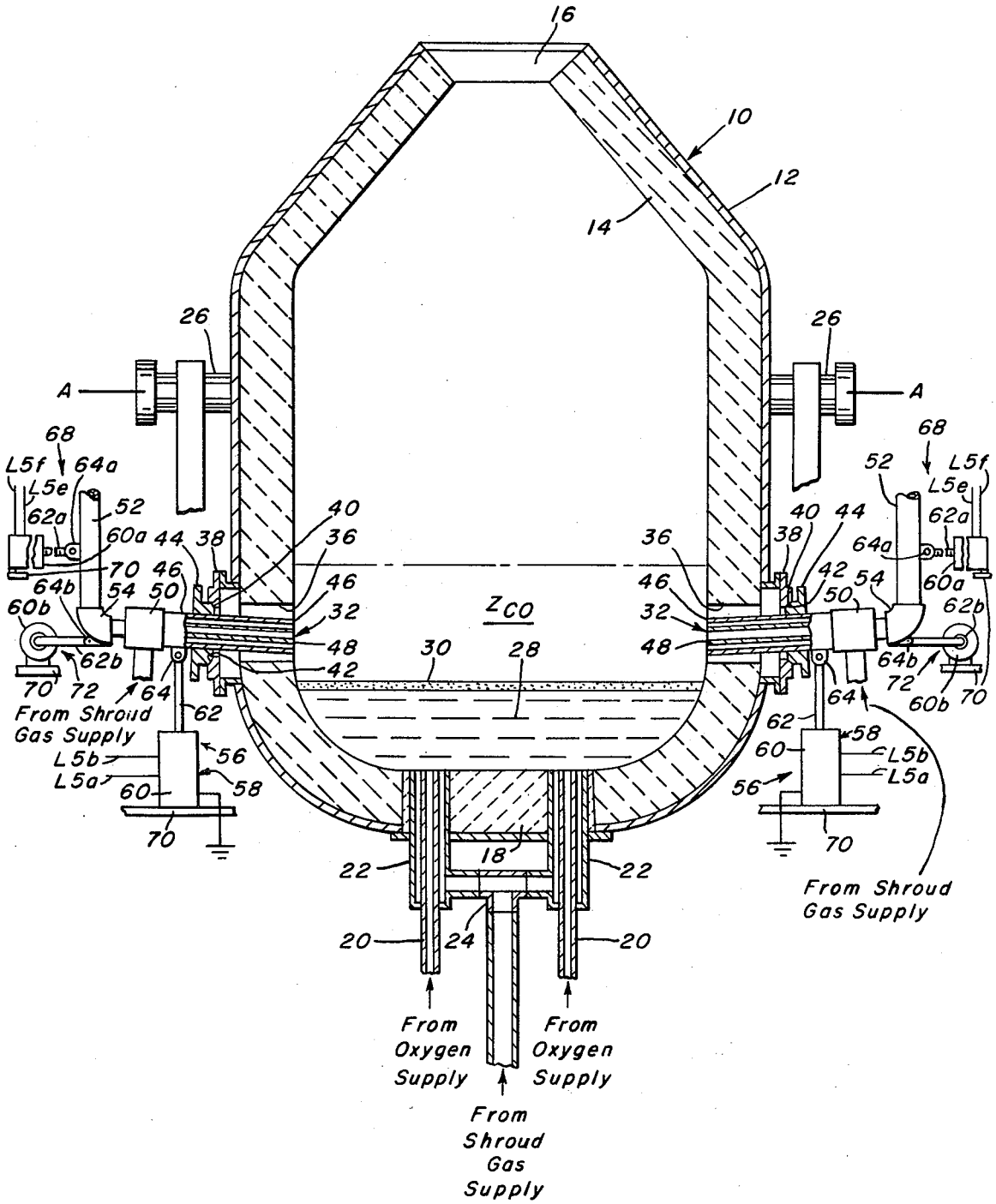
FIG. 1 is a vertical cross sectional view of a Q-BOP type converter or vessel rotatable about a horizontal axis A—A defined by the trunnions and provided with a plurality of bottom tuyeres and the improved side tuyeres of the present invention.

With specific reference to the form of this invention illustrated in the drawings and referring particularly to FIG. 1, a Q-BOP converter or vessel is indicated generally by the reference numeral 10.

CONVERTER 10

As shown in FIG. 1, this converter 10 has a metallic shell 12, a refractory brick lining 14, a mouth 16, and a bottom plug 18 containing a plurality of bottom tuyeres 20 surrounded by a plurality of concentric shroud gases pipes 22. Such bottom tuyeres 20 (FIG. 1) are fed a supply of oxygen or oxygen bearing gas from a source indicated by the legend "FROM OXYGEN SUPPLY" and the shroud gas pipes 22 are fed a shroud fluid, such as propane or the like, through a T-connection 24 (FIG. 1), extending to a shroud gas supply indicated by the legend "FROM SHROUD GAS SUPPLY."

Such converter 10 is rotatable on trunnions 26 (FIG. 1) about a horizontal axis indicated by the centerline A—A and is adapted during the refining process to contain a molten metal bath 28 (FIGS. 1, 3, 6, 7, 8) covered by a slag layer 30.

Mounted in the side walls of the converter 10 are the improved side tuyeres 32 (FIGS. 1–3, 6–8) which form a part of the improved apparatus for optimum burning of carbon monoxide produced in a carbon monoxide zone $Z_{CO}$ (FIGS. 1, 3, 6–8) to carbon dioxide thereby producing a substantially maximum amount of heat within the converter 10 to melt scrap metal (not shown) in the converter 10.

SIDE TUYERES 32

Figure 2:
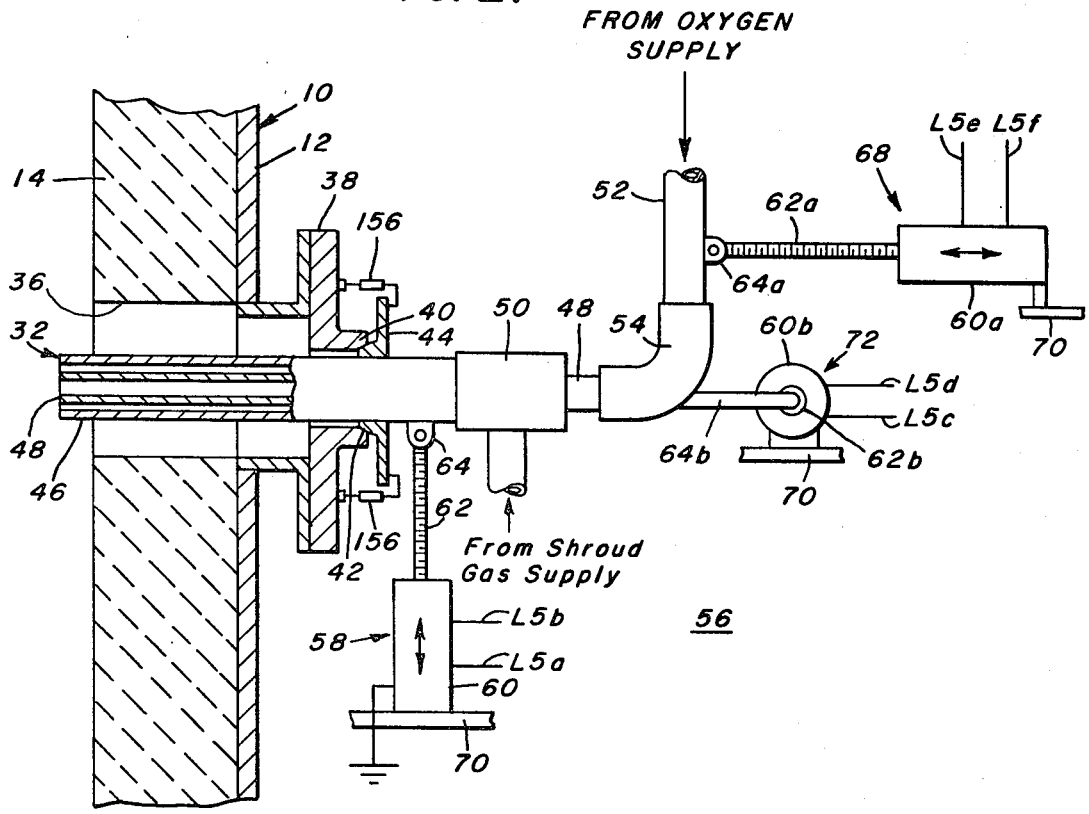
FIG. 2 is an elarged fragmentary vertical sectional view and showing the right hand side tuyere of FIG. 1 mounted in a clearance cavity within the shell and refractory lining of the converter, the ball and socket type mounting of the side tuyere on the converter shell, a manually operating turnbuckle arrangement for rotating or moving the side tuyere relative to the converter by hand, and an improved automatic tuyere operating means connected to the side tuyere and including a tuyere vertical operating means, a tuyere horizontal operating means, and a tuyere transverse operation means.

As shown particularly in FIGS. 1 and 2, each side tuyere 32 is mounted to project through a clearance hole 36 (FIGS. 1, 2) in the shell 12 and refractory brick lining 14. In order to mount the side tuyere 32 for vertical movement with respect to the converter 10, a mounting flange 38 (FIGS. 1, 2) projects from the shell 12 and carries an annular seat 40 (FIGS. 1, 2) engageable with a ball 42 (FIGS. 1, 2) and mounted on a flange 44 upstanding from a side tuyere shroud pipe 46 (FIGS. 1,2).

Figure 4:
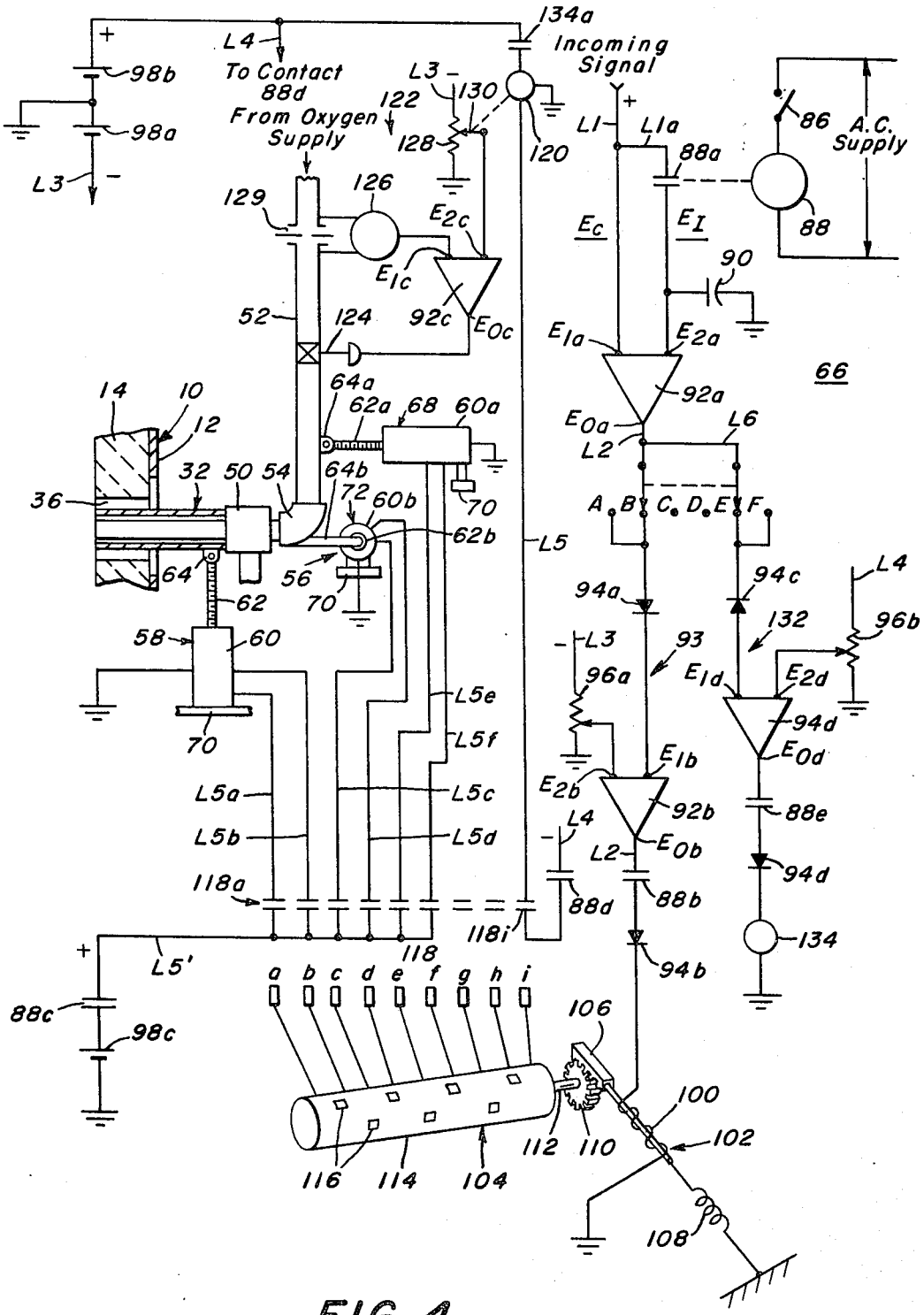
FIG. 4 is a diagrammatic wiring diagram of the control means or device of the present invention for receiving the initial effectiveness signal and the continuing effectiveness signal from the sensing means of FIG. 3, and for programming the movement of the side tuyere and the control of the oxygen flow rate to such side tuyere depending on whether the continuing effectiveness signal is greater than or less than an initial effectiveness signal.

Contained within the side tuyere shroud pipe 46 is the concentric side tuyere oxygen pipe 48 (FIGS. 1, 2). In order to supply a shroud fluid, such as propane or the like, to the annulus defined by the oxygen pipe 48 and the shroud pipe 46, a T-connection 50 (FIGS. 1, 2) is connected to a shroud gas supply indicated by the legend "FROM shroud GAS SUPPLY." The means utilized to provide oxygen to the side tuyere oxygen pipe 46 comprises an oxygen supply pipe 52 (FIGS. 1, 2) and an elbow 54 (FIGS. 1, 2) connecting such oxygen supply pipe 52 to the side tuyere oxygen pipe 48. As shown in FIGS. 1, 2, and 4, tuyere operating means 56 are provided for moving each side tuyere 32 vertically, horizontally, or transversely with respect to the converter 10.

TUYERE OPERATING MEANS 56 TUYERE VERTICAL OPERATING MEANS 58

As shown in FIGS. 1, 2 ad 4, the tuyere operating means 56 has a tuyere vertical operating means 58, suitably an electric motor 60 of the type SMO manufactured by Raco Machine Company of Bethel Park, Pennsylvania. This electric motor 60 has its piston rod 62 (FIGS. 1, 2, 4) pivotably connected to a bracket 64 projecting from the underside of the side tuyere shroud pipe 46 and is operable in response to a control device 66 shown in FIG. 4 to oscillate each side tuyere 32 a predetermined amount up or down in a vertical plane by means of its ball and seat connection 42, 44 (FIGS. 1, 2) to the converter 10 to achieve maximum heat from the conversion of the carbon monoxide in the carbon monoxide zone $Z_{CO}$ to carbon dioxide.

TUYERE HORIZONTAL OPERATING MEANS 68

Additionally, the tuyere operating means 56 has a tuyere horizontal operating means 68 (FIGS. 1, 2, 4) having an electric motor 60*a* similar to the electric motor 60. The electric motor 60*a* has its piston rod 62*a* pivotably secured by means of a bracket 64*a* to the supply pipe 52. For the purpose of permitting the side tuyere 32 to move in and out in a horizontal plane with respect to the converter 10, the electric motor 60*a* is mounted on slide guides 70 (FIG. 2) secured on the bottom of the electrical motor 60*a*.

TUYERE TRANSVERSE OPERATING MEANS 72

Figure 7:
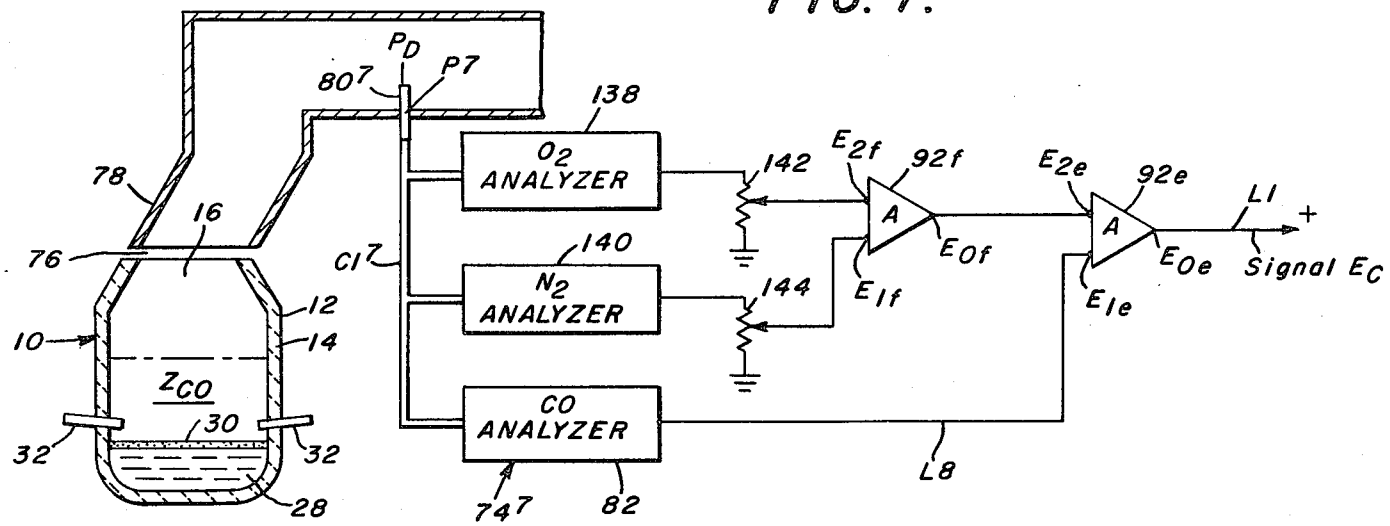
FIG. 7 is a view similar to FIGS. 3 and 6 of another alternative embodiment of the sensing showing a carbon monoxide probe arrangement disposed at a predetermined point within the hood and having an oxygen analyzer and nitrogen analyzer for sensing the ratio of oxygen to nitrogen at the predetermined probe point to indicate the amount of oxygen burned within the gas collecting hood from the air admitted between the converter and the gas collecting hood and hence the amount of carbon monoxide burned to carbon dioxide in the gas collecting hood prior to the predetermined probe point, which oxygen analyzer and nitrogen analyzer produce an output signal which is correlated with the output signal from the carbon monoxide analyzer to produce resultant initial and continuing effectiveness signals.

In addition, a tuyere transverse operating means 72 (FIGS. 1, 2, 4) has another electric motor 60*b* with its piston rod 62*b* conncted at its free end to a bracket 64*b* projecting from the elbow 54 of the side tuyere 32 so that in response to a signal from the control device 66 shown in FIG. 7, the tuyere transverse operating means 72 may move each side tuyere 32 transversely in and out in a plane with respect to the converter 10. The tuyere transverse operating means shown in FIGS. 1, 2, and 4 has the electric motor 60b also mounted on a slide guide 70 to permit the horizontal reciprocable movement of the side tuyere 32 in a plane with respect to the converter 10.

Figure 3:
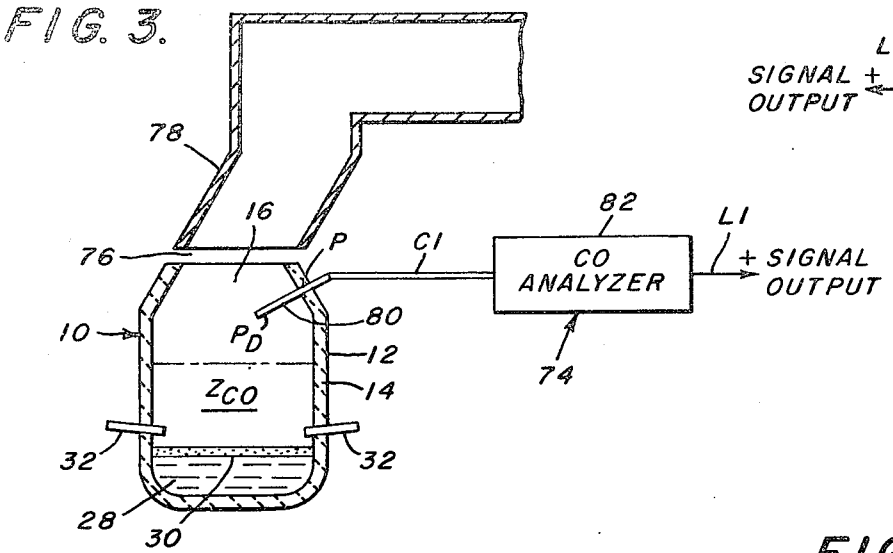
FIG. 3 is a vertical sectional diagrammatic view of a converter and an associated gas collecting hood and showing a preferred embodiment of a sensing means having a carbon monoxide probe inserted through the side wall of the converter adjacent the carbon monoxide zone for sampling the carbon monoxide content adjacent such carbon monoxide zone and for producing a signal output to the improved control device of the present invention.

As shown in FIG. 3, a sensing means 74 is associated with the converter 10 for sensing an initial effectiveness signal $E_I$ (FIG. 4) of the amount of carbon monoxide in the carbon monoxide zone $Z_{CO}$ being burned to carbon dioxide at a pedetermined point such as the point $P_D$ (FIG. 3).

SENSING MEANS 74

As shown in FIG. 3, adjacent the mouth 16 of the converter 10, ambient air is admitted through an opening 76 between the mouth 16 of the converter 10 and a gas collecting hood 78. The sensing means 74 has a probe 80 which projects from the point P in the side wall of the converter 10 for sensing the amount of carbon monoxide adjacent the carbon monoxide zone $Z_{CO}$ being burned to carbon dioxide above the carbon monoxide zone $C_{CO}$ at the predetermined probe point $P_D$. The probe 80 and gas sample preparation system may be of the type manufactured by Bailey Meter Company of Cleveland, Ohio, and transmits a gas sample by means of line C1 (FIG. 3) to a carbon monoxide analyzer 82 of the type LIRA 200 manufactured by Mine Safety Appliances Company of Pittsburgh, Pennsylvania. This carbon monoxide analyzer 82 produces an output signal which is directly proportional to the amount of unburned carbon monoxide above the carbon monoxide zone $Z_{CO}$ at the predetermined probe point $P_D$ and hence inversely proportional to the carbon monoxide being burned to carbon dioxide in the carbon monoxide zone $Z_{CO}$.

It will be understood as hereinafter explained in detail, that output signals from analyzer 82 are conducted by means of line L1 (FIGS. 3 and 4) to the control device 66 shown in FIG. 4 labeled "Incoming Signal" to provide the initial effectiveness signal $E_I$ (FIG. 4) and the continuing effectiveness signal $E_C$ (FIG. 4) which is compared to the initial effectiveness signal $E_I$ in the control device 66. It will be also understood as hereinafter explained in detail, that as the effectiveness signal increases in magnitude, it indicates that less scrap melting is occurring.

CONTROL DEVICE 66 TIMER 84

Figure 5:
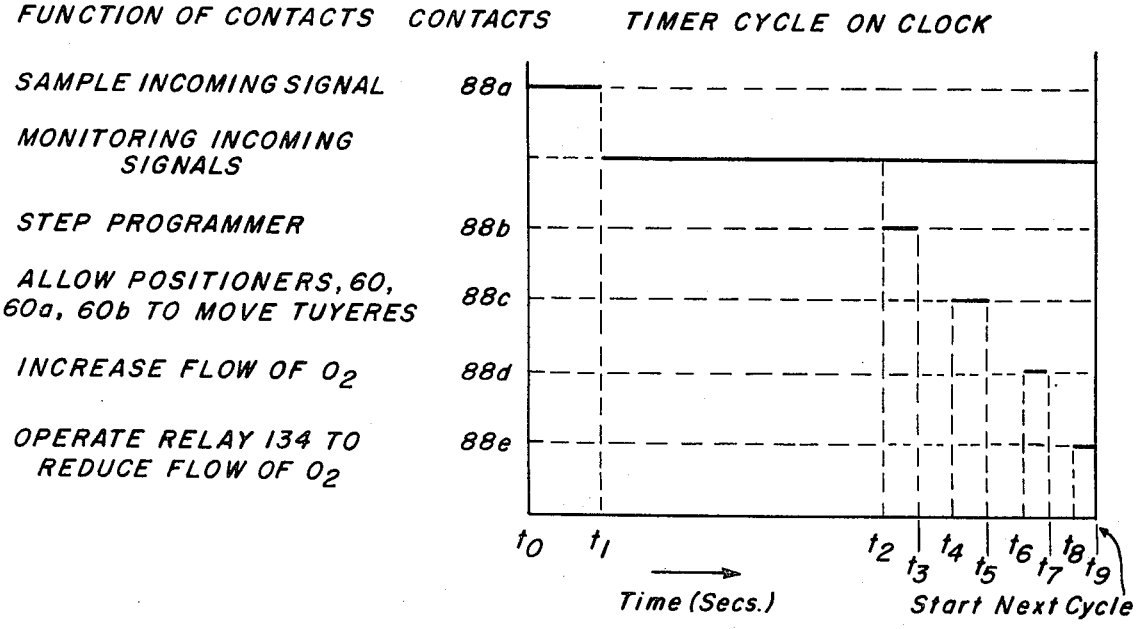
FIG. 5 is a time chart showing the operation at timed preselected time periods of the contacts of a timer associated with the control device for timing the operation of such control device during a single cycle of the operation of the control device.

This control device 66 (FIG. 4) has a timer 88 of the type HL manufactured by Eagle Signal of Davenport, Iowa, which timer 88 is connected through a manually operated starting switch 86 (FIG. 4) to the voltage supply indicated by the legend "AC SUPPLY." Upon closure of the starting switch 86, the timer 88 is energized thereby closing (as shown in FIG. 5) for the period of time $T_1$–$T_0$, a normally open timer contact 88a in branch line L1a (FIG. 4). Upon closure of the timer contact 88*a*, the initial effectiveness signal $E_I$ coming from the sensing means 74 (FIG. 3) is stored in a capacitor 90 in branch line L1A.

At the end of the above mentioned period of time $T_1$–$T_0$ (FIG. 5) timer contact 88*a* opens and the stored initial effectiveness signal $E_I$ continues to be applied to one input terminal $E_{2a}$ of a differential amplifier 92*a* of the type P65A manufactured by Teledyne-Philbrick of Dedham, Massachusetts. Thereafter, the continuing effectiveness signal $E_c$ from the sensing means 74 (FIG. 3) is fed via line L1 (FIG. 4) to the other output terminal $E_{1a}$ of the differential amplifier 92*a*. If during the period of time $T_9$–$T_1$ (FIG. 5) the continuing effectiveness signal $E_c$ on the input terminal $E_{1a}$ (FIG. 4) of the differential amplifier 92*a* is greater than the initial effectiveness signal $E_I$ on the input terminal $E_{2a}$ (FIG. 4) of the differential amplifier 92*a*, an outut signal $E_{oa}$ from the amplifier 92*a* is positive and is fed via line L2 through a blocking diode 94*a* to one input terminal $E_{1b}$ of another differential amplifier 92*b* in a first control loop 93.

FIRST CONTROL LOOP 93

For the purpose of boosting the input signal from output $E_{oa}$ of amplifier 92*a* to input $E_{1b}$ of differential amplifier 92*b*, a booster potentiometer 96*a* (FIG. 4, connected by line L3 to a battery 98*a*) has its output fed to an input terminal $E_{2b}$ FIG. 4) of the differential amplifier 92*b* so that the output signal from output $E_{ob}$ of the differential amplifier 92*b* is fed via line L2 (FIG. 4) through a now closer timer contact 88*b* (during the period $T_3$–$T_2$, FIG. 5) and such output signal from output $E_{ob}$ of amplifier 92*b* is fed through a blocking diode 94*b* (FIG. 4) to a solenoid coil 100 of a drive mechanism 102 for a program means, such as the programmer 104 or of the type Model 250 manufactured by the Tenor Company of Milwaukee, Wisconsin.

DRIVE MEANS 102

Upon energization of the solenoid coil 100, a rack 106 (FIG. 4) is moved against the action of a biasing spring 108 away from the biasing spring 108 to index a pinion 110 on a shaft 112 a predetermined angular distance. The shaft 112 also carries a program drum 114 (FIG. 4).

PROGRAMMER 104

The program associated with the programmer 104 is applied to the program drum 114 by means of program pins 116 (FIG. 4) which actuate in turn a plurality of program switches 118*a*–118*i*.

If, for example, the two switches 118*a*, 118*b* (FIG. 4) are energized by their associated program pins 116 during the time $T_5$–$T_4$ (FIG. 4), the timer 88 causes the timer contact 88*c* (FIG. 4) to close so that voltage from battery 98*c* is applied via lines $L_5'$, $L_{5a}$, $L_{5b}$ to, for example, the tuyere vertical operating means 58 (i.e., the electric motor 60) so that during such time period $T_5$–$T_4$ (FIG. 5), the piston rod 62 of the electric motor 60 elevates, the example, the side tuyere 32 a predetermined distance relative to the converter 10 thereby attempting to increase the amount of carbon monoxide in the carbon monoxide zone $Z_{CO}$ being burned to carbon dioxide.

If, for example, on the next cycle of the control device 66, the contacts 118*c*, 118*d* (FIG. 4) are similarly energized, then during such time period T5–T4 (FIG. 5) the tuyere transverse operating means 72 (i.e., the electric motor 60b) would, for example, be energized through lines $L_5'$, $L_{5c}$, $L_{5d}$ to move the side tuyere 32 in or out from the plane of FIG. 4 a predetermined amount to again attempt to adjust the position of the side tuyere 32 to obtain an increased amount of carbon monoxide in the carbon monoxide zone $Z_{CO}$ being burned to carbon dioxide.

Again, if during the third cycle of operation of the control device 66, program switches 118*e*, 118*f* are closed by the associated program pins 116 thereby energizing the horizontal tuyere operating means 68 (i.e., the electric motor 60*a* via lines $L_5$, $L_{5e}$, $L_{5f}$ during the time period $T_5$–$T_4$, FIG. 5) the electric motor 60a moves the side tuyere 32 either in or out a predetermined amount with respect to the side wall of the converter 10.

Finally, if on the fourth cycle of operation of the control device 66, as the switch 118*i* (FIG. 4) is closed by the associated program pins 116 and if during the period of time T7–T6 (FIG. 5) the timer 88 closes the timer contact 88*d* (FIG. 4) a voltage is applied from the battery 98*b* via line L4 and line L5 to an electric motor 120, which electric motor 120 forms a part of air oxygen control loop 122 (FIG. 4).

OXYGEN CONTROL LOOP 122

Flow control means, such as a control valve 124 (FIG. 4) of the type Mark I manufactured by Valtek of Provo, Utah, is disposed in the supply line 52 for controlling the flow of the oxygen or oxygen bearing gas through the supply line 52. Flow sensing means, such as a differential pressure transmitter 126 (FIG. 4) of the type E13DH manufactured by The Foxboro Company of Foxboro, Massachusetts, is associated with an orifice 129 (FIG. 4) in the supply line 52 and transmits its output signal to an input terminal $E_{1c}$ of a differential amplifier 92*c*. A variable potentiometer 128 (FIG. 4) is connected by line L3 to the battery 98*a* and has its movable arm 130 driven by the electric motor 120. The variable set point signal from the variable potentiometer 128 is fed to the input $E_{2c}$ of the differential amplifier 92*c*, which amplifier 92*c* has its output $E_{0c}$ connected to the control valve 124.

Thus, when the switch 118*i* of the programmer 104 is closed and the timer contact 88*d* is closed by the timer 88 (period $T_7$–$T_6$, FIG. 5), the electric motor 120 is operable to increase the voltage signal of the variable potentiometer 128 so that the output signal from output $E_{0c}$ of the differential amplifier 92*c* opens the control valve 124 thereby increasing the flow of oxygen through the oxygen supply line 52 to the side tuyere 32.

If, on the other hand, during the monitoring period $T_9$–$T_1$ (FIG. 5), the initial effectiveness signal $E_I$ on the input terminal $E_{2a}$ of the differential amplifier 92*a* is greater than the continuing effectiveness signal $E_c$ on the input terminal $E_{1a}$ of the differential amplifier 92*a*, the output $E_{0A}$ will be negative and the blocking diode 94*a* in line L2 (FIG. 4) will prevent the passage of the output signal from output $E_{0A}$ of the differential amplifier 92*a* through line L2 to the differential amplifier 92*b*, in the first control loop 93, and the blocking diode 94*c* in line L6 (FIG. 4) will admit such output signal from output $E_{0A}$ of differential amplifier 92*a* through a second oxygen control loop 132 via line L6 to input terminal $E_{1d}$ of differential amplifier 94*d*.

The blocking diode 94*c* will, of course, refuse any signal from output $E_{oa}$ of amplifier 92*a* when the continuing effectiveness signal $E_c$ is greater than the initial effectiveness signal $E_I$ during the monitoring period T7–T1 (FIG. 1).

SECOND OXYGEN CONTROL LOOP 132

In order to boost the signal received on input $E_{1d}$ of the differential amplifier 94*d* (FIG. 4), a booster potentiometer 96*b* (FIG. 4) fed from battery 98*b* by line L4 provides a booster voltage to input terminal $E_{2d}$ of the differential amplifier 94*d* so that the output from output $E_{od}$ of the differential amplifier 92*d* is fed through blocking diode 94*d* (FIG. 4, when the timer 88 closes the timer contact 88*e*, FIG. 5, during the period T9–T8, FIG. 5) thereby energizing a relay 134 in line L6 (FIG. 4). Energization of the relay 134 causes closure of normally open relay contact 134*a* (FIG. 4) in line L4 so that a positive voltage from battery 98*b* is fed via line L4 to the electric control motor 120 thereby moving the arm 130 of the variable potentiometer 128 so that control valve 124 is moved further closed thereby reducing the oxygen flow rate through the supply pipe 52 and conserving oxygen which is not required.

ALTERNATIVE EMBODIMENTS

Figure 6:
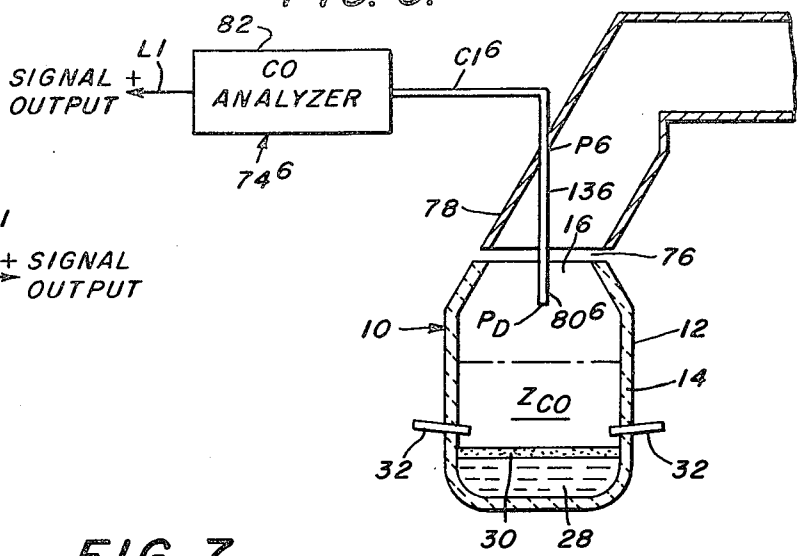
FIG. 6 is a view similar to FIG. 3 of an alternative embodiment of the sensing means showing the carbon monoxide probe inserted through the gas collecting hood in the form of a lance having its sampling end adjacent the carbon monoxide zone within the converter.

It will be understood by those skilled in the art that alternatively, as shown in FIG. 6, that the sensing means 74$^6$ has its probe 80$^6$ affixed to a lance 136 depending from point P6 in the wall of the gas collecting hood 78 to the predetermined probe point $P_D$ above the carbon monoxide zone $Z_{CO}$. Such probe 80$^6$ is connected by the line Cl$^6$ to the carbon monoxide analyzer 82. The output signal from the analyzer 82 is carried, as before, by the line L1 to the control device 66 of FIG. 4. The predetermined point $P_D$ at which the probe 80$^6$ senses the carbon monoxide content is above the carbon monoxide zone $Z_{CO}$ within the converter 10.

In FIG. 7, the probe 80$^7$ extends from a point P7 within the gas collecting hood 78 to the predetermined probe point $P_D$ of the probe located a considerable distance above the opening 76 between the mouth 16 of the converter 10 and the bottom of the gas collecting hood 78. In FIG. 7, the gas sample is fed by conduit $C_1^7$ to a sensing means 74$^7$ including the carbon monoxide analyzer 82, with the output of analyzer 82 being fed via line L8 to input $E_{1e}$ of differential amplifier 92*e*. In order to compensate such input signal to input $E_{1e}$ of the differential amplifier 92*e* from the carbon monoxide analyzer 82 for the amount of carbon monoxide which is burned to carbon dioxide in the gas collecting hood 78 prior to the predetermined probe point $P_D$, the gaseous sample is fed by the line $Cl^7$ to both an oxygen analyzer 138 of the type 7803 manufactured by Leeds & Northrup of North Wales, Pennsylvania, and a nitrogen analyzer 140 of the chromatograph type manufactured by Benoix-Greenbriar of Ronceverte, West Virginia.

The ratio of oxygen to nitrogen at the predetermined point $P_D$ (FIG. 7) indicates the amount of oxygen which has been burned in the gas collecting hood 78 prior to the predetermined probe point $P_D$.

The output signals from the analyzers 138 and 140 are fed through respective calibrating potentiometers 142, 144 (FIG. 7) to inputs $E_{2f}$ and $E_{1f}$ respectively of a differential amplifier 92*f* so that the output signal from output $E_{of}$ of differential amplifier 92*c* thus calibrating the other input signal from the carbon monoxide analyzer 82 at input $E_{1e}$ of differential amplifier 92*e* and thereby providing from output $E_{oe}$ of amplifier 92*e* the initial and calibrated effectiveness signals $E_1$, $E_c$ via line L1 to the control device 66 (FIG. 4).

Figure 8:
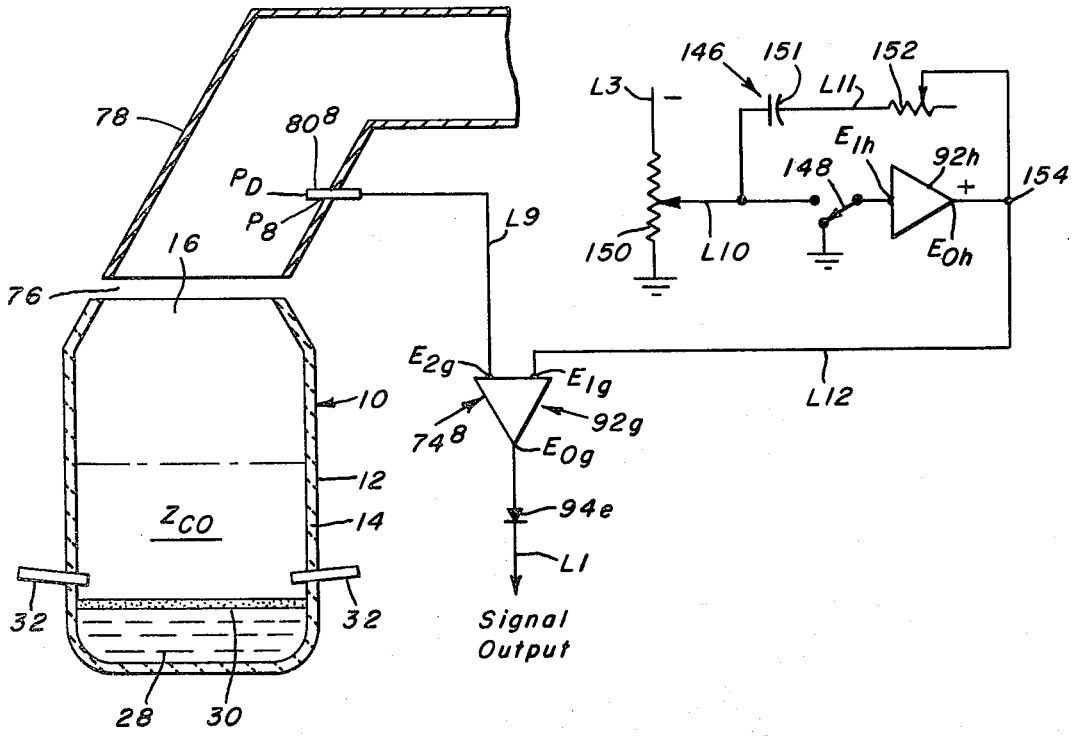
FIG. 8 is a view similar to FIGS. 3, 6, 7 and showing another alternative embodiment of the sensing means having a temperature probe disposed in the gas collecting hood above the jointure of such gas collecting hood and the mouth of the converter for sensing the temperature of the off gases within the gas collecting hood and for comparing the continuing effectiveness temperature signal with a programmed initial temperature set point and a programmed constant slope type standard circuit devised to produce an output signal which is inversely proportional to the temperature sensed within the hood.

In FIG. 8, a temperature probe $80^8$ enters the hood 78 at P8 and measures the temperature of the gases in the hood at the predetermined point $P_D$. Line L9 carries the temperature signal to one input $E_{2g}$ of differential amplifier 92*g*. In the standard signal device 146, an initial temperature signal potentiometer 150 feeds through line L10 and a manually operated starting switch 148 to input $E_{1h}$ of differential amplifier 92*h*. Branch L11 carries such signal also through capacitor 151 and a normal rate or slope potentiometer 152, so that the output from potentiometer is joined at junction 154 with the output signal from output $E_{oh}$ of amplifier 92*h* and fed via line L12 to input $E_{1g}$ of amplifier 92*g*. The standard signal device 146 produces an output proportional to the hood temperature when the scrap is being properly melted. This signal is compared with the actual temperature by differential amplifier 92*g*.

Figures 1, 9:
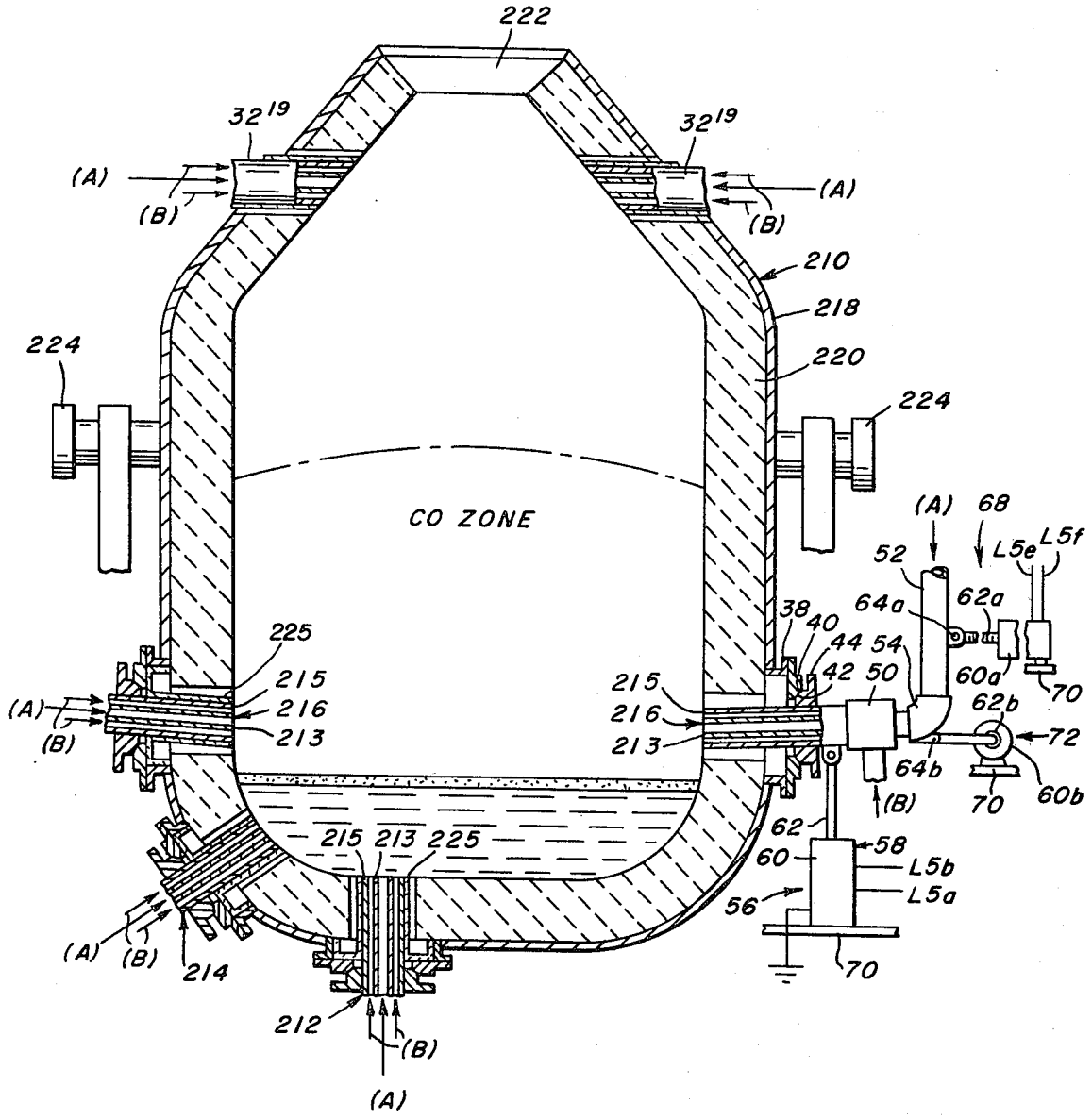
FIG. 9 is a vertical sectional view of a bottom blown oxygen converter showing a submerged bottom tuyere, a side submerged tuyere, a pair of side tuyeres directed toward the carbon monoxide zone of the furnace and a pair of mouth tuyeres.

From a consideration of FIG. 9, it will be apparent that the present invention may be employed with a bottom blown converter 210 having a bottom submerged tuyere 212, a side submerged tuyere 214, and a part of side tuyeres 216 directed toward the carbon monoxide zone (CO zone). This bottom blown converter 210 has a shell 218 provided with a refractory lining 220 and a mouth 222 and is rotatable on trunnions 224. The tuyeres 212, 214, 216 are provided with a high temperature refractory protective covering 225 and are adapted to carry in an inner pipe 213 either a fluid alone, such as oxygen, air, argon, or mixtures thereof, or entrained pulverized additives therein; such as a fluxing agent (burned lime (CaO) or the like), a liquefying agent (fluorspar ($CaF_2$) or the like), or a blocking or deoxidizing agent (ferro manganese or the like), and in an outer pipe 215 a shroud gas, such as propane, natural gas, light fuel oil or the like.

Figure 10:
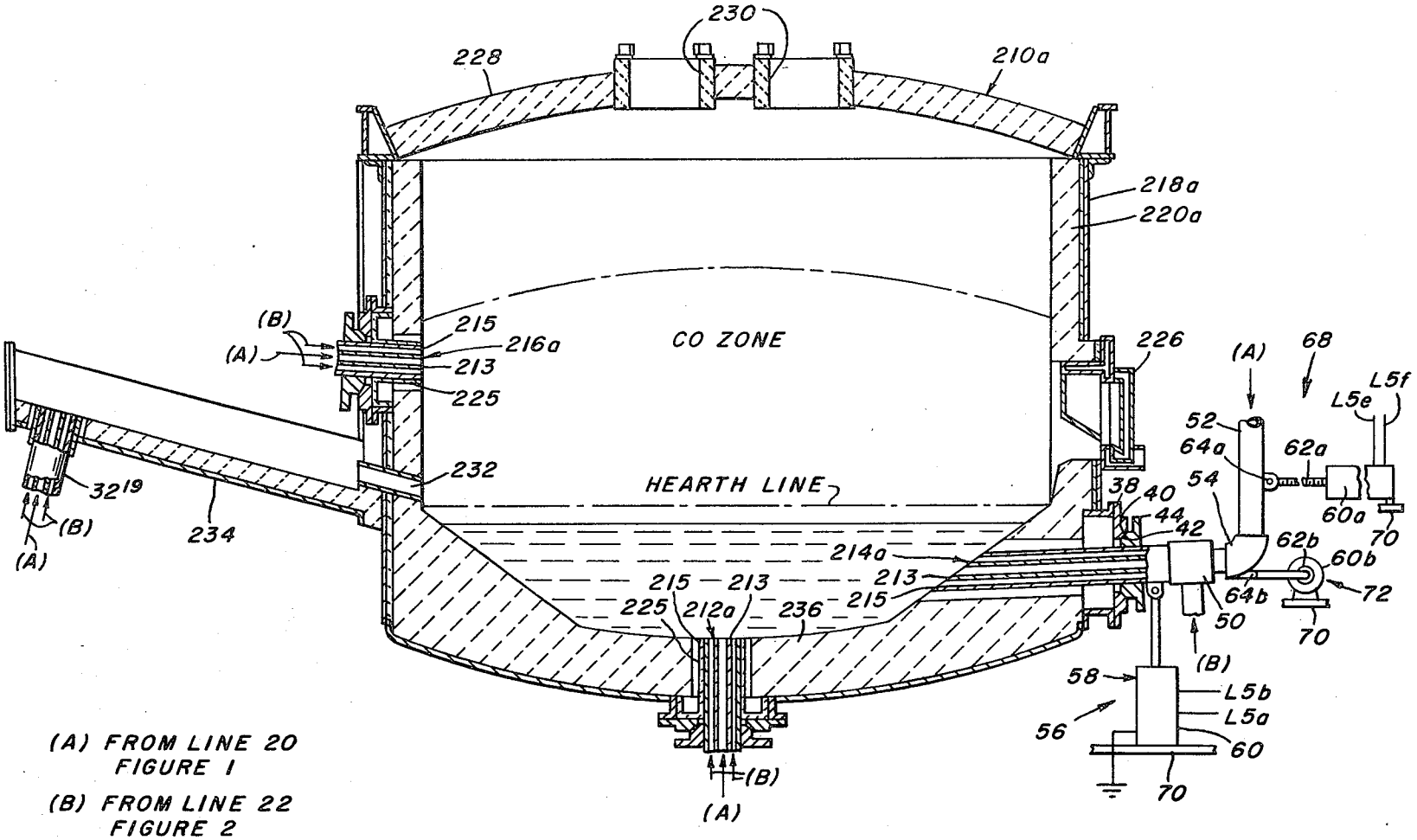
FIG. 10 is a vertical sectional view of an electric-arc steelmaking furnace showing a bottom vertical submerged tuyere, a submerged side tuyere, a side tuyere directed toward the cabon monoxide zone of the furnace and a mouth tuyere for the discharge spout.

As shown in FIG. 10, the present invention is also applicable to a HEROULT Type electric-arc steelmaking furnace 210*a* provided with a bottom submerged tuyere 212*a*, a side submerged tuyere 214*a*, and a side tuyere 216*a* directed toward the carbon monoxide zone (CO zone) of the furnace 210*a*. This electric-arc steelmaking furnace 210*a*, a side door 226, a refractory roof 228 provided with electrode holes 230, a tap hole 232, and a pouring spout 234 extending from the tap hole 232. The tuyeres 212, 214*a*, 216*a* are provided with a high temperature refractory protective covering 225 and are adapted to carry in an inner pipe 213 either a fluid along, such as oxygen, air, argon, or mixtures thereof, or entrained pulverized additives therein, such as fluxing agent (burned lime (CaO) or the like), a liquefying agent (fluorspar ($CaF_2$) or the like), or a blocing or deoxidizing agent (ferro manganese or the like), and in a outer pipe 215, a shroud gas, such as propane, natural gas, light fuel oil or the like.

Figure 11:
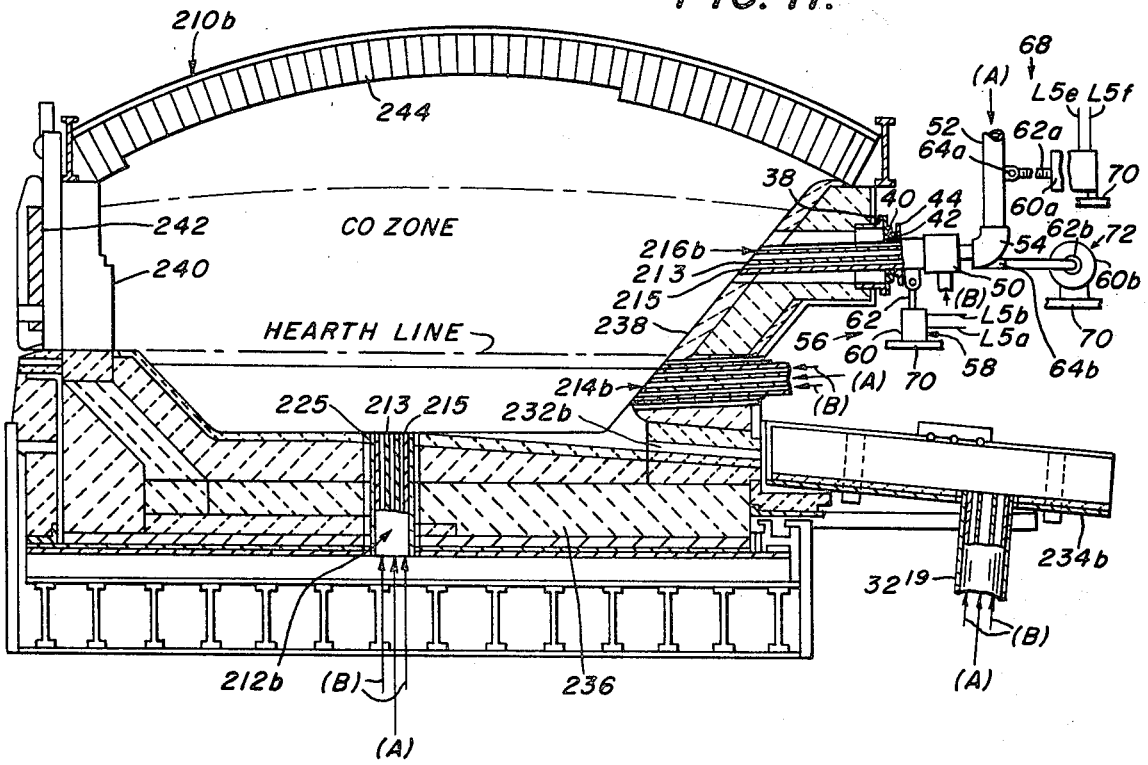
FIG. 11 is a vertical sectional view of an open hearth furnace utilizing a vertical submerged tuyere, a side submerged tuyere, another side tuyere directed toward the carbon monoxide zone of the furnace, and a mouth tuyere for the discharge spout.

In addition, the present invention may be employed as shown in FIG. 11 with the open hearth furnace 210*b* having a bottom submerged tuyere 212*b*, a side submerged tuyere 214*b*, and a side tuyere 216*b* directed toward the carbon monoxide zone (CO zone) of the furnace 210*b*. This open hearth furnace 210*b* includes a refractory lined bottom 236, a refractory lined sloping back wall 238, a refractory lined front wall 240, a charging door 242 in the wall 240, and a refractory lines roof 244. A tap hole 232*b* opposite the charging door 242 leads to a pouring spout 234*b*. The tuyeres 212*b*, 214*b*, 216*b* are provided with a high temperature refractory protective covering 225 and are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), or a blocking or deoxidizing agent (ferro mnganese or the like) and in an outer pipe 215, a shroud gas, such as propane, natural gas, light fuel oil or the like.

Figure 12:
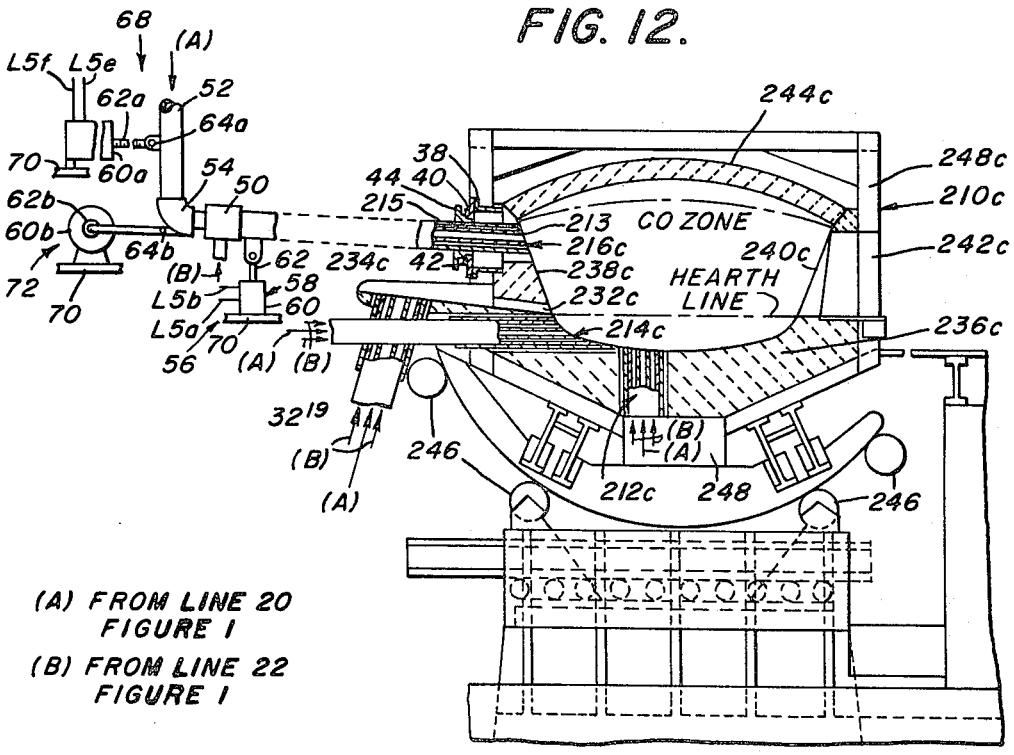
FIG. 12 is a vertical sectional view of a tiltable open hearth furnace having a vertical bottom submerged tuyere, a side submerged tuyere, side tuyere directed toward the carbon monoxide zone of the furnace and a mouth tuyere for the dischage spout.

Again as shown in FIG. 12, the present invention may be employed with a tilting open hearth furnace 210*c* mounted on rollers 246 arranged in a circular path for providing rotation on the longitudinal axis of the furnace 210*c* for pouring the refined steel through a tap hole 232*c* and a pouring spout 234*c*. As shown in FIG. 11, the tiltable open hearth furnace 210*c* has a bottom submerged tuyere 212*c* extending through a box 248. In addition, a submerged side tuyere 214*c* and a side tuyere 216*c* directed toward the carbon monoxide zone (CO zone) of the furnace 210*c* are employed. The tiltable open hearth furnace 210*c* has a refractory lined bottom 236*c*, refractory lined back wall 238*c*, refractory lined front wall 240*c* (provided with a charging door 242*c*) and a refractory lined roof 244*c*. The tuyeres 214*c*, 214*c*, 216*c* are provided wih a high temperature refractory covering 225 and are adapted to carry in an inner pipe 213 either a fluid along, such as oxygen, air, argon, or mixtures thereof, or entrained pulverized additives, therein, such as fluxing agent (burned lime (CaO) or the like), a liquefying agent (fluorospar ($CaF_2$) or the like), or a blocking or deoxidizing agent (ferro manganese or the like), and in an outer pipe 215, a shroud gas, such as propane, natural gas, light fuel oil or the like.

Figure 13:
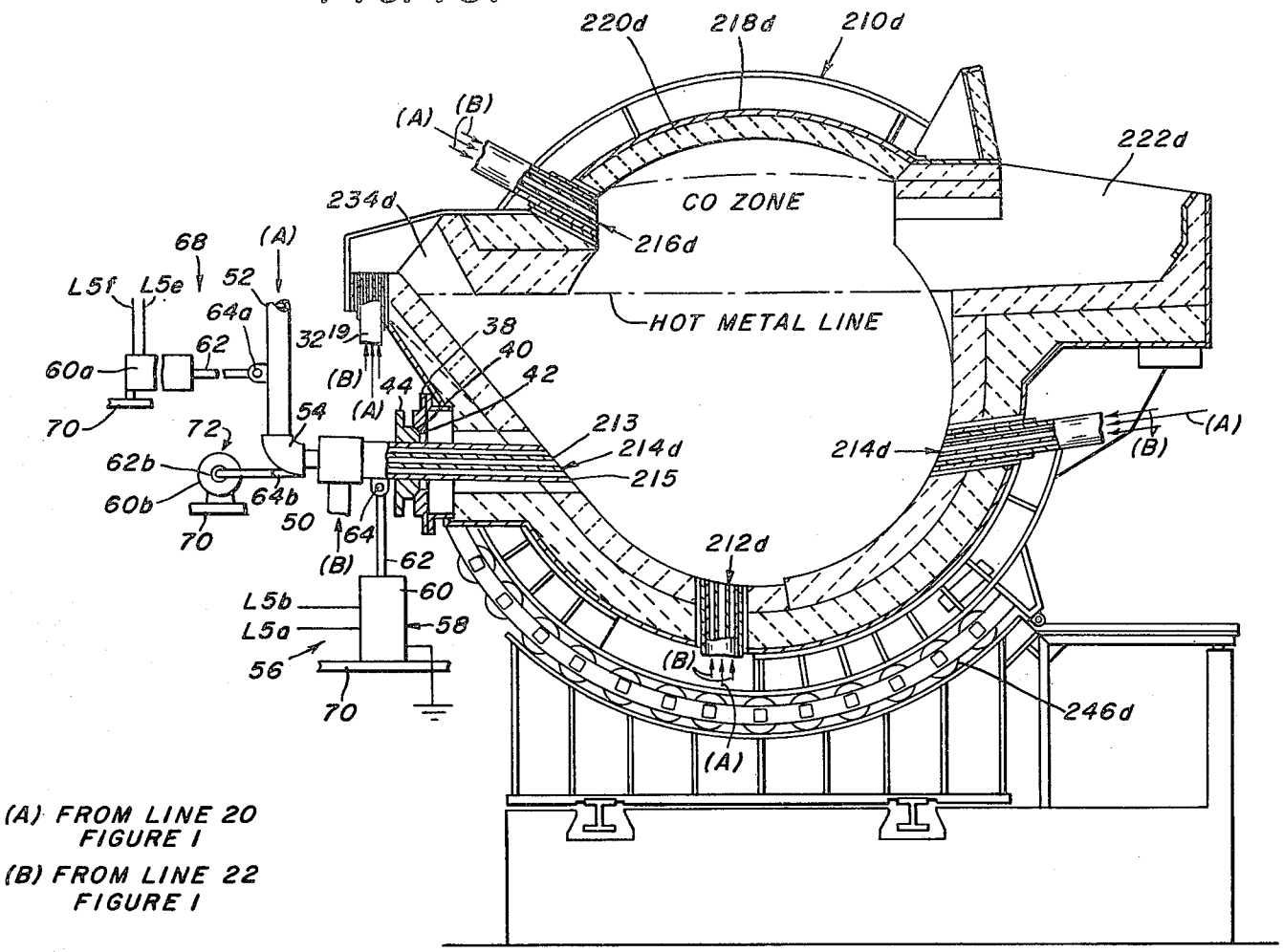
FIG. 13 is a vertical sectional view of oscillatable hot metal mixer having a vertical bottom submerged tuyere, a pair of side submerged tuyeres, a side tuyere directed toward the carbon monoxide zone of the mixer and a mouth tuyere for the discharge spout.

In FIG. 13, the present invention is employed with a hot metal mixer 210*d* having a shell 218*d* provided with a refractory lining 220*d*, and having also an inlet mouth 222*d* and a pouring spout 234*d*. The mixer 210*d* is oscillatable on rollers 246*d* between the charging and discharging positions. Such mixer 210*d* has a bottom submerged tuyere 212*d*, a side submerged tuyere 214*d*, and side tuyere 216*d* directed toward the carbon monoxide zone (CO zone) of the mixer 210*d*. The tuyeres 212*d*, 214*d*, 216*d* are provided with a high temperature refractory covering 225 and are adpated to carry in an inner pipe 213 either a fluid aong, such as oxygen, air, argon, or mixtures thereof, or entrained pulverized additives therein, such as a fluxing agent (burned lime (CaO) or the like), a liquefying agent (fluorospar ($CaF_2$) or the like), or a blocking or deoxidizing agent (ferro manganese or the like), and in an outer pipe 215, a shroud gas such as propane, natural gas, light fuel oil or the like.

A discharge tuyere or tuyeres 32[19] (FIGS. 9, 10, 11, 12, 13) is disposed adjacent a discharge opening, such as the mouth 22 (FIG. 9); the pouring spouts 234 (FIG. 10), 234*b* (FIG. 11), 234*c* (FIG. 12), and 234*d* (FIG. 13) to prevent the formation of skulls adjacent or on the discharge opening during the pouring operation particularly those chromium-nickel skulls produced during the refining of stainless steel.

METHOD

It will be understood from the above description of the apparatus shown in FIGS. 1–8 that an improved method of optimum burning of the carbon monoxide produced in the carbon monoxide zone $Z_{CO}$ (FIGS. 1–3, 6–8) to carbon dioxide is also a part of this invention. The improved method includes the steps of:

a. sensing the initial effectiveness signal $E_I$ of the amount of carbon monoxide in the carbon monoxide zone $Z_C$ being burned to carbon dioxide at a predetermined point such as $P_D$ (FIG. 3), $P_D$ (FIG. 6), $P_D$ (FIG. 7), and $P_D$ (FIG. 8) relative to the converter 10;

b. monitoring a continuing effectiveness signal $E_c$;

c. comparing the continuing effectiveness signal $E_c$ with the initial effectiveness signal $E_I$; and d. moving the side tuyere 32 relative to the converter 10 when the continuing effectiveness signal $E_c$ is greater than the initial effectiveness signal $E_I$ to increase the amount of carbon monoxide in the carbon monoxide zone $Z_{CO}$ being burned to carbon dioxide.

In addition, a further step is contemplated of:

a. increasing the flow of oxygen to the side tuyere 32 when the continuing effectiveness signal $E_c$ is greater than the initial effectiveness signal $E_I$ to increase the amount of carbon monoxide in the carbon monoxide zone $Z_{CO}$ being burned to carbon dioxide.

Finally, the improved method also includes the step of:

a. decreasing the flow of oxygen to the side tuyere 32 when the continuing effectiveness signal $E_c$ is less than the initial effectiveness signal $E_I$ to conserve oxygen in the refining process.

SUMMARY OF THE ACHIEVEMENTS OF THE OBJECTS OF THE INVENTION

It will be recognized by those skilled in the art that the objects of this invention have been achieved by providing an improved method of optimum burning of carbon monoxide produced in a carbon monoxide zone within a converter to carbon dioxide, which improved apparatus and method:

a. provide an improved and novel control device 66 (FIG. 4) which can either position a side tuyere 32 or adjust the oxygen flow rate to the side tuyere 32 in response to a signal which is a measure of the effectiveness of the side tuyere position and the oxygen flow rate through such side tuyere 32;

b. provide a substantially maximum amount of heat generated in the carbon monoxide zone $Z_{CO}$ above the molten metal bath 28 in the vessel 10 to permit maximum scrap usage in the refining process;

c. utilize all available heat from the refining process and the burning of the carbon monoxide zone $Z_{CO}$ for scrap melting;

d. continuously monitor either the carbon monoxide content at a predetermined point $P_D$ (FIGS. 3, 6–8) relative to the converter 10 or the temperature of the off gases above the carbon monoxide zone $Z_{CO}$ at such predetermined point $P_D$ against an initial effectiveness signal $E_I$; and e. time the operation of the initial effectiveness signal $E_I$, the monitored continuing effectiveness signal $E_C$, the comparison therebetween, the movement of the side tuyere 32 relaive to the converter 10 and the change in the oxygen supply to the side tuyere 32 as a programmed cycle.

While in the accordance with the patent statutes, preferred and alternaive embodiments of this invention have been illustrated and described in detail, it is to be particularly understood that the invention is not limited thereto or thereby.

We claim

1. A method of optimum burning of carbon monoxide produced in a carbon monoxide zone being fed oxygen by a side tuyere above a molten metal bath in a converter, to carbon dioxide thereby producing a substantially maximum amount of heat within said converter to melt scrap in said converter, said method including the steps of a. sensing in initial effectiveness signal of the amount of carbon monoxide in said carbon monoxide zone being burned to carbon dioxide at a predetermined point relative to said converter;

b. monitoring a continuing effectiveness signal;

c. comparing said continuing effectiveness signal with said initial effectiveness signal; and d. moving said side tuyere relative to said converter when said continuing effectiveness signal is greater than said initial effectiveness signal to increase the amount of carbon monixide in said carbon monoxide zone being burned to carbon dioxide

2. The method recited in claim 1 including the step of a. sensing the amount of carbon monoxide in said carbon monoxide zone being burned to carbon dioxide as said effectiveness signal.

3. The method recited in claim 1 including the step of:

a. sensing the temperature of the off gases above said carbon monoxide zone as said effectiveness signal.

4. The method recited in claim 2 including the step of:

a. sensing the amount of carbon monoxide in said carbon monoxide zone being burned to carbon dioxide above said carbon monoxide zone (FIGS. 3, 4) as said predetermined point.

5. The method recited in claim 2 including the step of:

a. sensing the amount of carbon monoxide in said carbon monoxide zone being burned to carbon dioxide in a gas collecting hood above said converter as said predetermined point.

6. The method recited in claim 3 including the step of:

a. sensing the temperture of the off gases in a gas collecting hood above said converter as said predetermined point.

7. The method recited in claim 5 including the step of:

a. sensing the ratio of oxygen to nitrogen at said predetermined point to indicate the amount of oxygen burned in said gas collecting hood from the air admitted between said converter and said gas collecting hood and hence the amount of carbon monoxide burned to carbon dioxide in said hood prior to said predetermined point.

8. The method recited in claim 7 including the step of:

a. compensating said effectiveness signal for the amount of carbon monoxide burned to carbon dioxide in said hood prior to said predetermined point.

9. The method recited in claim 1 including the step of:

a. moving said side tuyere vertically relative to said converter when said continuing effectiveness signal is greater than said initial effectiveness signal to increase the amount of carbon monoxide in said carbon monoxide zone being burned to carbon dioxide.

10. The method recited in claim 1 including the step of:

a. moving said side tuyere horizontally relative to said converter when said continuing effectiveness signal is greater than said initial effectiveness signal to increase the amount of carbon monoxide in said carbon monoxide zone being burned to carbon dioxide.

11. The method recited in claim 1 including the step of:

a. moving said side tuyere transversely relative to said converter when said continuing effectiveness signal is greater than said initial effectiveness signal to increase the amount of carbon monoxide in said carbon monoxide zone being burned to carbon dioxide.

12. The method recited in claim 1 including the step of:

a. timing the sensing, monitoring and comparing of said continuing effectiveness signal and said initial effectiveness signal, and the moving of said side tuyere.

13. A method of optimum burning of carbon monoxide produced in a carbon monoxide zone being fed oxygen by a side tuyere above a molten metal bath in a converter to carbon dioxide thereby producing a substantially maximum amount of heat within said converter to melt scrap in said converter, said method including the steps of:

a. sensing an initial effectiveness signal of the amount of carbon monoxide in said carbon monoxide zone being burned to carbon dioxide at a predetermined point relative to said converter;

b. monitoring a continuing effectiveness signal;

c. comparing said continuing effectiveness signal with said initial effectiveness signal; and d. increasing the flow of oxygen to said side tuyere when said continuing effectiveness signal is greater than said initial effectiveness signal to increase the amount of carbon monoxide in said carbon monoxide zone being burned to carbon dioxide.

14. A method of optimum burning of carbon monoxide produced in a carbon monoxide zone being fed oxygen by a side tuyere above a molten metal bath in a converter to carbon dioxide thereby producing a substantially maximum amount of heat within said converter to melt scrap in said converter, said method including the steps of:

a. sensing an initial effectiveness signal of the amount of carbon monoxide in said carbon monoxide zone being burned to carbon dioxide at a predetermined point relative to said converter;

b. monitoring a continuing effectiveness signal;

c. comparing said continuing effectiveness signal with said initial effectiveness signal; and d. decreasing the flow of oxygen to said side tuyere when said continuing effectiveness signal is less than said initial effectiveness signal to conserve oxygen.

15. The method recited in claim 1 wherein said tuyere is a bottom submerged tuyere.

16. The method recited in claim 1 wherein said tuyere is a submerged side tuyere.

17. The method recited in claim 1 wherein said side tuyere is directed toward a carbon monoxide zone above said iron base melt.

18. The method recited in claim 1 wherein said tuyere is a tuyere disposed adjacent a discharge opening to prevent formation of skulls adjacent said discharge opening during pouring of said molten metal.

* * * * *

UNITED STATES PATENT OFFICE

CERTIFICATE OF CORRECTION

Patent No. 3,997,335 Dated December 14, 1976

Inventor(s) William A. Kolb et al.

It is certified that error appears in the above-identified patent and that said Letters Patent are hereby corrected as shown below:

Column 2, line 39, "elarged" should be --enlarged--;

Column 3, line 13, after "sensing" insert --means--;

Column 4, line 54 "FROM shroud GAS SUPPLY" should be --"FROM SHROUD GAS SUPPLY"--;

Column 4, line 65 "ad" should be --and--;

Column 5, line 27 "conncted" should be --connected--;

Column 6, line 51 " FIG. 4)" should be --(FIG.4)--;

Column 6, line 54, "closer" should be --closed--;

Column 7, line 15, "the" first occurrence should be --for -

UNITED STATES PATENT OFFICE

CERTIFICATE OF CORRECTION

Patent No. 3,997,335 Dated December 14, 1976

Inventor(s) William A. Kolb et al.

It is certified that error appears in the above-identified patent and that said Letters Patent are hereby corrected as shown below:

Column 7, line 35, "$L_5$" should be --$L_5$'--;

Column 9, line 19, after "of" insert --such--;

Column 9, line 19, "$92_c$" should be --$92_f$--;

Column 9, line 19, after "$92_c$" insert --is fed to input $E_{2e}$ of differential amplifier 92e--;

Column 9, line 33, after "Branch" insert --line--;

Column 9, between lines 41 and 42 insert the following five paragraphs:

UNITED STATES PATENT OFFICE

CERTIFICATE OF CORRECTION

Patent No. 3,997,335 Dated December 14, 1976

Inventor(s) William A. Kolb et al. Page 3 of 5

It is certified that error appears in the above-identified patent and that said Letters Patent are hereby corrected as shown below:

--The output signal from output $E_{og}$ of amplifier 92g is fed through line L1 and blocking diode 94e which allows only positive signals to be applied to the control device 66.

It will be understood from the above description that if insufficient carbon monoxide is being burned in the carbon monoxide zone $Z_{CO}$ (Figure 8), the temperature signal from output $E_{og}$ of a differential amplifier 92g will increase, thereby requiring adjustment of the control system by the control device 66 (Figure 4) as hereinbefore explained.

It will also be understood by those skilled in the art that the temperature probe $80^8$ of Figure 8 may be either located at the point $P_D$ of Figure 3, or disposed at $P_D$ on the lance 136 of Figure 6 or disposed at the predetermined point $P_D$ of Figure 7.

As shown in Figure 2, side tuyere 32 may be rotated manually by means of turnbuckles 156.

UNITED STATES PATENT OFFICE

CERTIFICATE OF CORRECTION

Patent No. 3,997,335 Dated December 14, 1976

Inventor(s) William A. Kolb et al. Page 4 of 5

It is certified that error appears in the above-identified patent and that said Letters Patent are hereby corrected as shown below:

In order to operate the second oxygen control loop 132 independently of the first control loop 93, selector switch 158 may be installed in lines L2, L6 to operate the loops 93, 132, either independently of each other or together.--

Column 9, line 46, "part" should be --pair--;

Column 10, line 4 "along" should be --alone--;

Column 10, line 8, "blocing" should be --blocking--;

Column 10, line 9, "a" first occurrence should be --an--;

Column 10, line 20, "lines" should be --lined--;

Column 10, line 29 "mnganese" should be --manganese--;

UNITED STATES PATENT OFFICE

CERTIFICATE OF CORRECTION

Patent No. 3,997,335 Dated December 14, 1976

Inventor(s) William A. Kolb et al. Page 5 of 5

It is certified that error appears in the above-identified patent and that said Letters Patent are hereby corrected as shown below:

Column 10, line 47, "$214_c$" first occurrence should be -- $212_c$ --

Column 10, line 49, "along" should be --alone--;

Column 10, line 68, "aong" should be --alone--;

Column 11, line 26, "$Z_c$" should be --$Z_{CO}$--;

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*